US011965292B2

(12) United States Patent
Simões Vicente

(10) Patent No.: US 11,965,292 B2
(45) Date of Patent: Apr. 23, 2024

(54) MODULAR PAVEMENT SYSTEM WITH A WEAR-PROTECTIVE SYSTEM

(71) Applicant: ISSG SPORTS INNOVATIONS, LDA, Feijó (PT)

(72) Inventor: Nuno Miguel Simões Vicente, Feijó (PT)

(73) Assignee: ISSG SPORTS INNOVATIONS, LDA, Feijó (PT)

( * ) Notice: Subject to any disclaimer, the term of this patent is extended or adjusted under 35 U.S.C. 154(b) by 312 days.

(21) Appl. No.: 17/188,156

(22) Filed: Mar. 1, 2021

(65) Prior Publication Data

US 2021/0180268 A1 Jun. 17, 2021

Related U.S. Application Data

(63) Continuation of application No. PCT/IB2019/057321, filed on Aug. 30, 2019.

(30) Foreign Application Priority Data

Aug. 31, 2018 (PT) ..... 111115

(51) Int. Cl.

| | |
|---|---|
| ***E01C 13/04*** | (2006.01) |
| ***E04F 15/10*** | (2006.01) |
| ***E04F 15/22*** | (2006.01) |

(52) U.S. Cl.

CPC ..... *E01C 13/04* (2013.01); *E01C 13/045* (2013.01); *E04F 15/10* (2013.01); *E04F 15/225* (2013.01); *E01C 2201/10* (2013.01); *E04F 2290/044* (2013.01)

(58) Field of Classification Search

CPC .... E01C 13/04; E01C 13/045; E01C 2201/10; E04F 15/225; E04F 2290/044

USPC ..... 404/36

See application file for complete search history.

(56) References Cited

U.S. PATENT DOCUMENTS

| | | | | |
|---|---|---|---|---|
| 4,440,818 | A * | 4/1984 | Buchan | E01C 5/005 428/117 |
| 5,250,340 | A * | 10/1993 | Bohnhoff | E01C 11/185 52/180 |
| D442,704 | S * | 5/2001 | Lee | E01C 9/004 D25/118 |
| 6,585,449 | B2 * | 7/2003 | Chen | E01C 11/226 404/36 |
| 7,303,800 | B2 * | 12/2007 | Rogers | B32B 3/02 428/44 |
| 8,099,915 | B2 * | 1/2012 | Moller, Jr. | E01C 11/24 52/177 |
| 8,128,311 | B2 * | 3/2012 | Son | E01C 13/083 403/326 |
| 8,341,896 | B2 * | 1/2013 | Moller, Jr. | E04F 15/22 52/177 |
| 8,656,662 | B2 * | 2/2014 | Moller, Jr. | E04F 15/10 52/177 |
| 8,696,241 | B2 * | 4/2014 | Lee | E04D 11/002 405/39 |

(Continued)

*Primary Examiner* — Gary S Hartmann

(57) ABSTRACT

A system including a pavement module that includes a protective system against wear and tear of rigid support elements of interconnected modules that form a covering of a pavement, or impact absorbers that integrate or are coupled to the pavement modules. The system consists of a pavement module with an upper side and a wear-protective system consisting of a protective shoe.

6 Claims, 4 Drawing Sheets

(56) References Cited

U.S. PATENT DOCUMENTS

| | | | | |
|---|---|---|---|---|
| 8,713,863 | B2 * | 5/2014 | Moller, Jr. | E04F 15/225 52/177 |
| 8,734,049 | B1 * | 5/2014 | Stiles | E01C 9/086 404/36 |
| 9,080,333 | B2 * | 7/2015 | Moller, Jr. | E04F 15/10 |
| 9,695,603 | B2 * | 7/2017 | Moller, Jr. | E01C 13/045 |
| 9,790,691 | B2 * | 10/2017 | Moller, Jr. | E04F 15/225 |
| 2021/0180269 | A1 * | 6/2021 | Simões Vicente | E04F 15/225 |

* cited by examiner

MODULAR PAVEMENT SYSTEM WITH A WEAR-PROTECTIVE SYSTEM

SCOPE OF THE INVENTION

This invention generically concerns pavement modules, more specifically a pavement module that includes a protective system against wear and tear of the rigid support elements of the interconnected modules that form the covering of a pavement, or the impact absorbers that integrate or are coupled to the pavement modules.

BACKGROUND OF THE INVENTION

Modular systems to cover pavements have long been known, and there is tremendous diversity of documents mentioning them, whether they are coverings in natural materials, such as wood or cork, or made of synthetic or artificial materials.

Mostly, this type of pavement is used to form a floor surface for sports and other activities in indoor and outdoor enclosures, and usually has as its primary function the covering of the pavement of the enclosure, usually made of cement. Additionally, by taking advantage of the possibility of the modules having different colors, this type of flooring can also be used to delimit different areas of the terrain, or to highlight an object that is placed on top of it.

Although the physical characteristics of the modules and the interconnection method between the modules offer a certain capacity against the wear of the rigid support elements of the modules, due to the type of forces to which these modules are subjected, the need arose for the modular systems for pavement covering to include resources that increase the durability of the rigid support elements of the modules. In addition, when shock absorbing equipment is placed on the pavement modules, the cushioning shoes also serve to protect this equipment.

Some documents were found that refer to pavement modules incorporating elements for shock absorption, which could possibly be considered as impact protectors.

In particular, the equipment referred to in document US2018195294 presenting a "Multi-stage shock absorbing modular floor tile" and in document KR101870386 describing a "Prefabricated flooring with height adjustment and shock absorption".

Unlike the product described in these documents, the equipment are designed to absorb shocks on pavement modules, not to serve as wear protectors for the pavements as for the shock absorbers that may be incorporated in the pavements, as does the equipment described in the present invention. In document KR101870386, the component (131) serves as a cover for the buffer (130), not as impact protectors of either the pavement module or the shock absorbers itself.

No document was found mentioning a solution, or pointing to a solution, that enables increasing the durability of the rigid support elements of the modules or of the equipment to absorb impacts in the pavement modules.

Advantages of the Invention

The fact that the cushioning system includes a protective shoe, in addition to increasing the durability of the rigid support elements of the modules, also offers greater stability to all the equipment, because the surface that contacts the pavement is substantially increased.

Additionally, although the wear protector does not serve as an impact absorber, due to the fact that there is a gap between the second rigid support element and the shoe base, and simultaneously due to the gap that is formed in the space between the body of the shoe and the pavement module, in cases where the modules rest on an irregular pavement or when an unexpected force is exerted on the pavement module, the protective shoe, being able to move in the gaps mentioned above, absorbs part or all of the impacts and irregularities of the pavement.

BRIEF DESCRIPTION OF THE DRAWINGS

These and other characteristics can be easily understood by means of the attached drawings, which are to be considered as mere examples and in no way restrictive of the scope of the invention. In the drawings, and for illustrative purposes, the measurements of some of the elements may be exaggerated and not drawn to scale. The absolute and relative dimensions do not correspond to the real ratios for the embodiments of the invention.

In a preferred embodiment.

Figure 1:
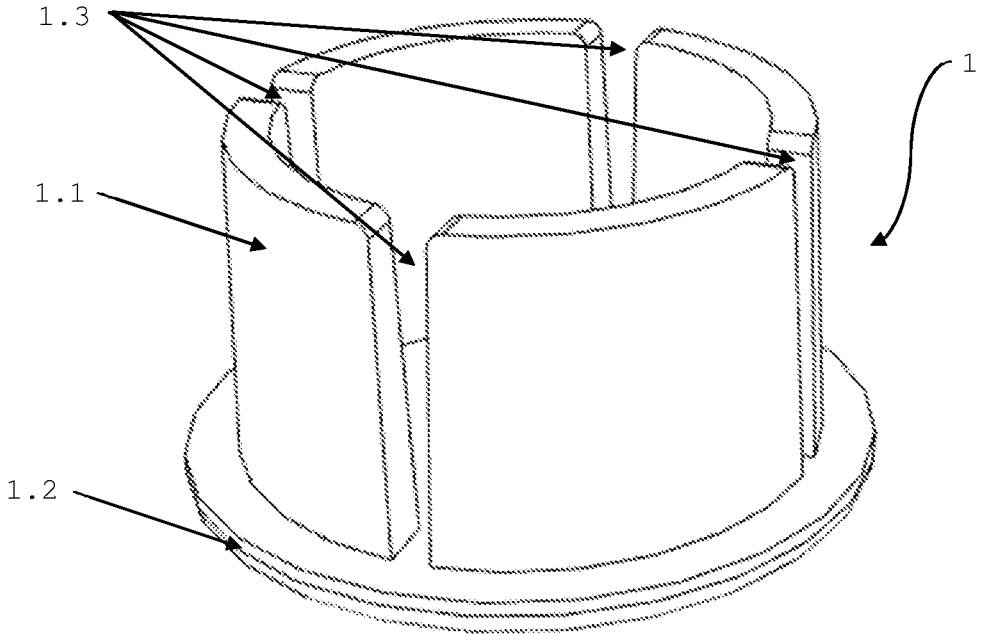
FIG. 1 shows a top view of the protective shoe of the invention's equipment.
Figure 2:
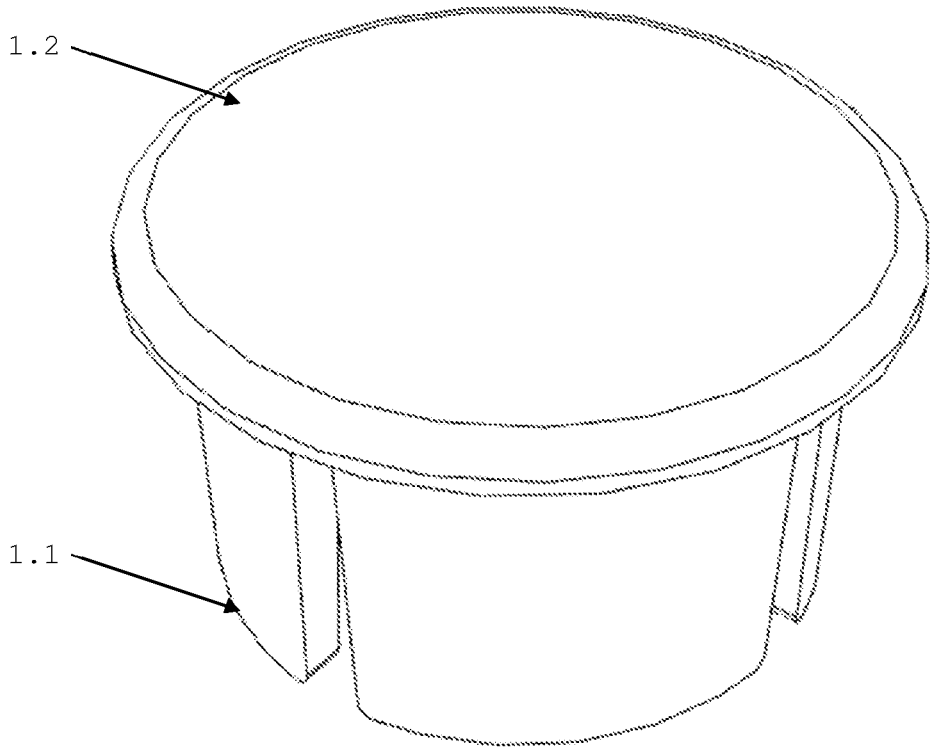
FIG. 2 shows a bottom view of the protective shoe of the invention's equipment.
Figure 3:
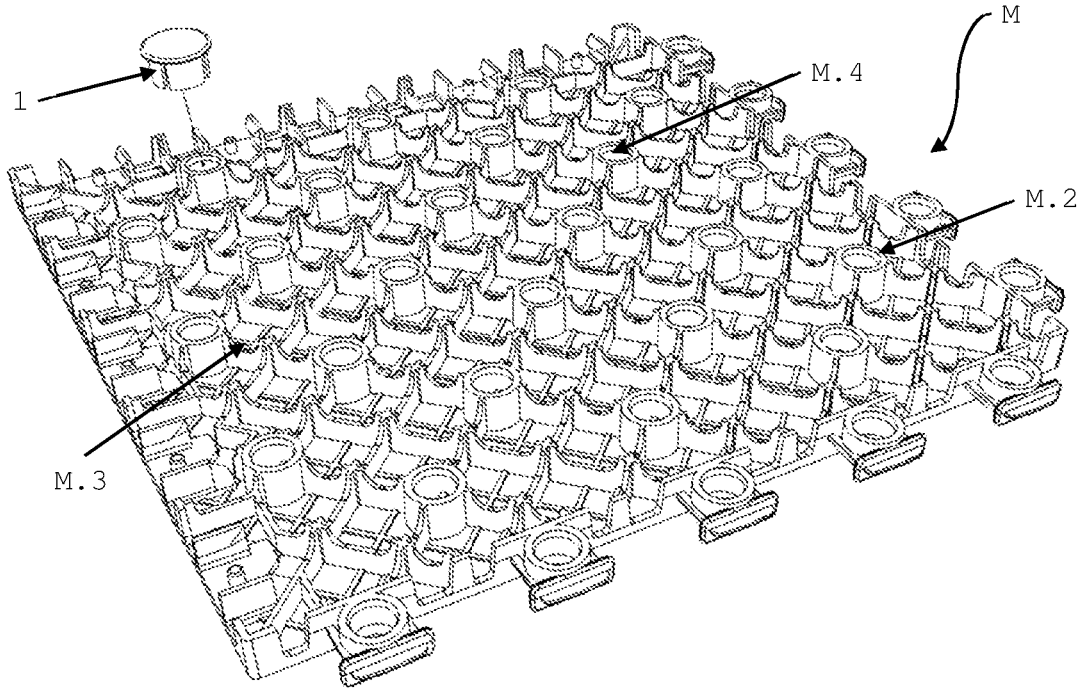
FIG. 3 shows a bottom view of the pavement module with the protective shoe to be inserted on the outside the first rigid support element.
Figure 4:
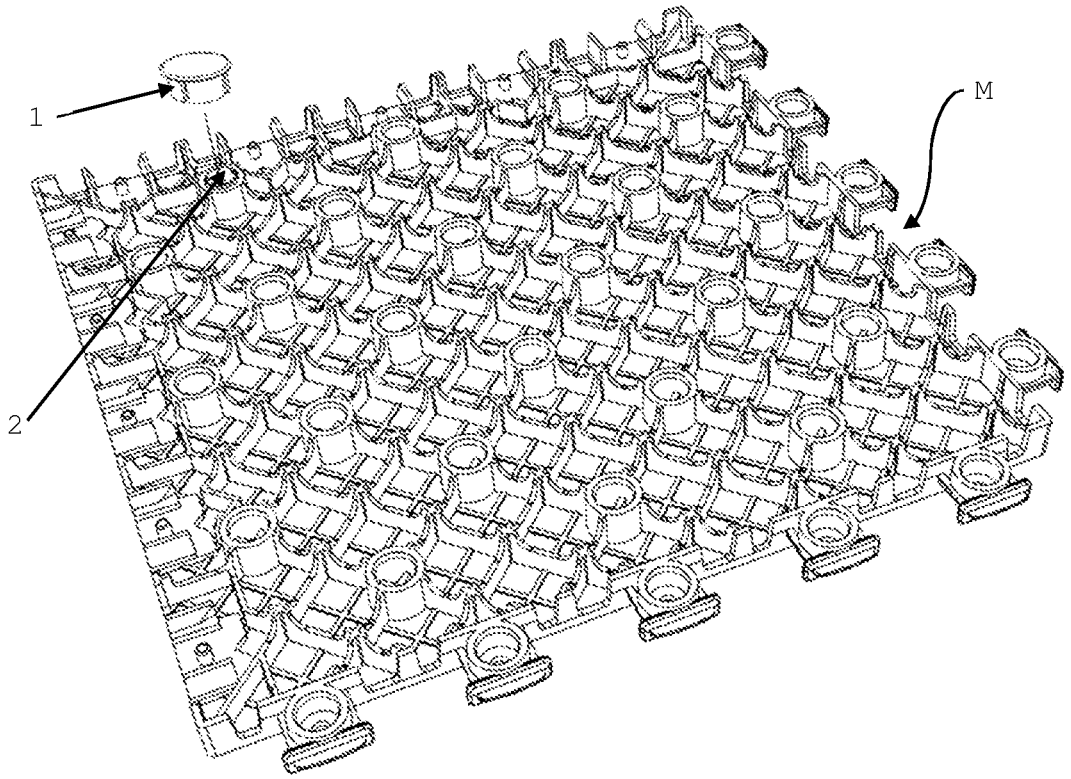
FIG. 4 shows a bottom view of the pavement module with the protective shoe to be inserted outside the first rigid support element after the impact absorber has been properly inserted inside the first rigid support element, i.e., in the recess.
Figure 5:
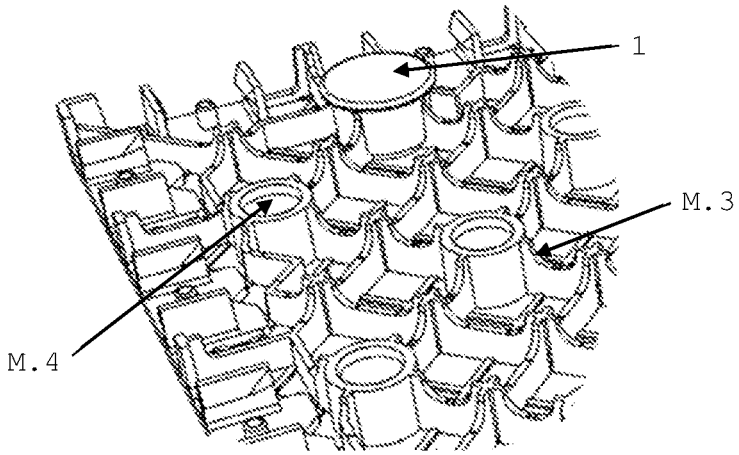
FIG. 5 shows a detail of a bottom view of the pavement module with the protective shoe suitably inserted on the outside the first rigid support element.
Figure 6:
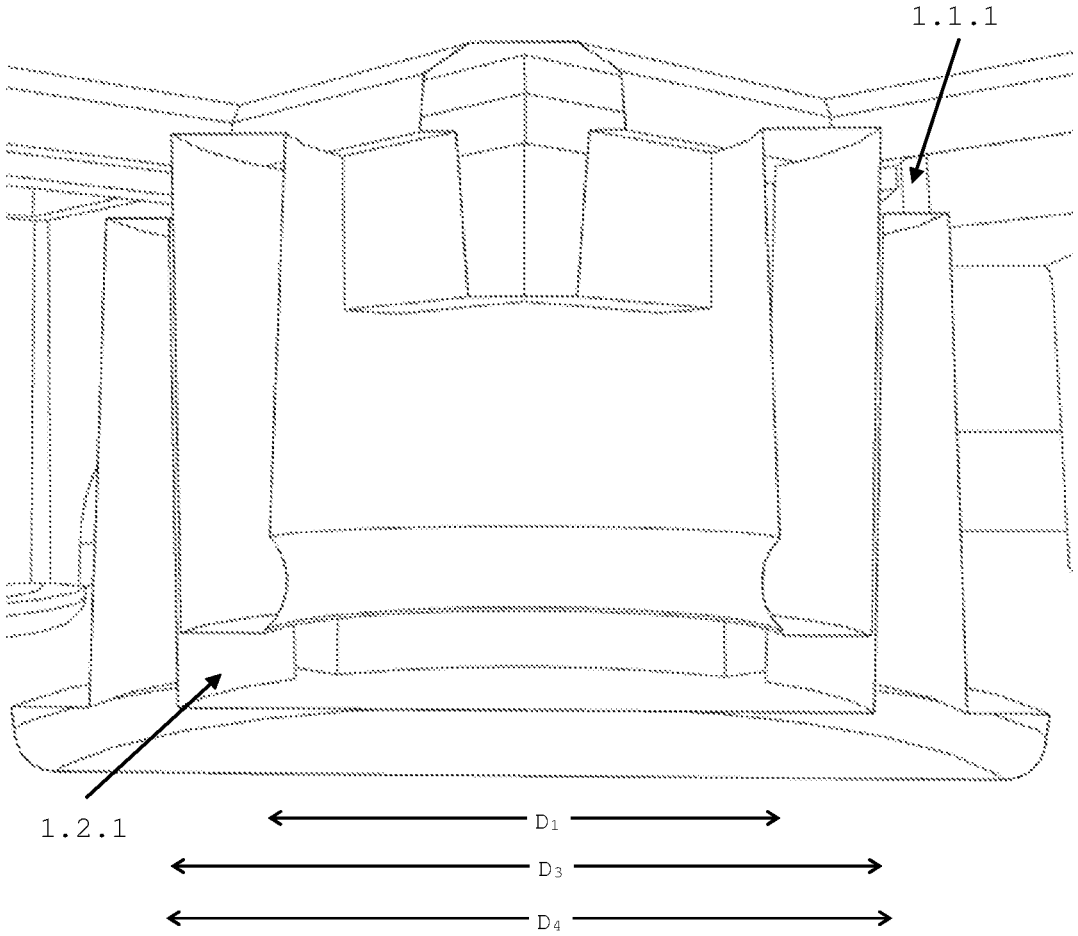
FIG. 6 shows a cross sectional view of the pavement module with the protective shoe properly inserted in the first rigid support element, showing the maximum inner diameter $D_1$ and maximum outer diameter $D_3$ of the first rigid support element, as well as the maximum inner diameter $D_4$ of the protective shoe. Body and base gaps are also shown.
Figure 7:
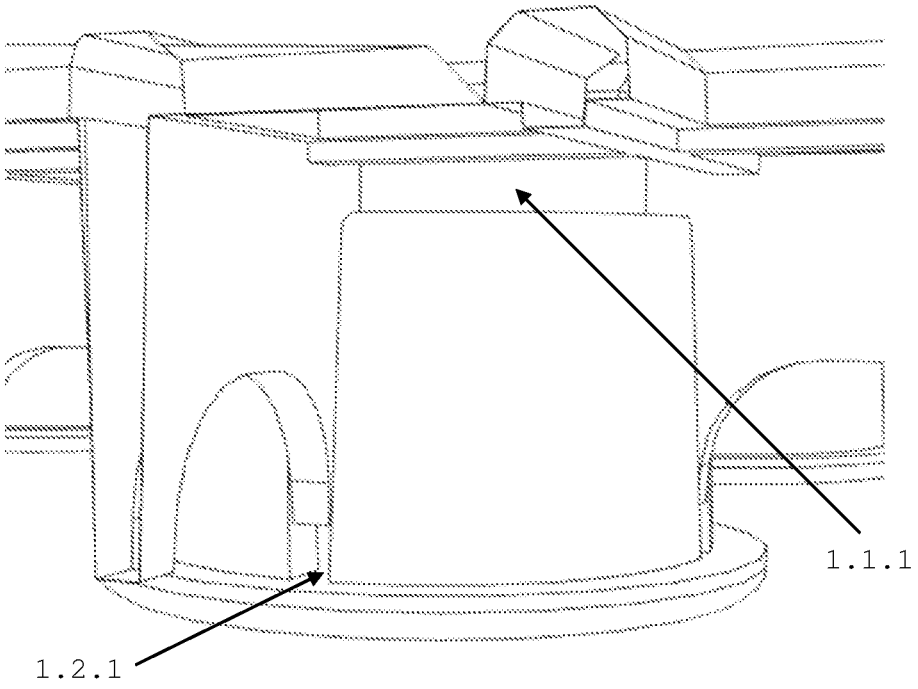
FIG. 7 shows a detail from a perspective view of the protective shoe properly fitted to the outside of the first rigid support element, showing the body and base gaps.

Marked in the figures are the elements and components of this invention's equipment, as well as elements necessary for its operation:

1—Protective shoe
1.1—Body of the shoe
1.1.1—Body gap
1.2—Shoe base
1.2.1—Base gap
1.3—Shoe grooves
2—Impact absorber
M—Pavement module
M.1—Top surface layer
M.2—First rigid support element
M.3—Second rigid support element
M.4—Recess

DETAILED DESCRIPTION OF THE INVENTION

The term "modular" refers to objects of regular or standardized units or dimensions that provide multiple components for the assembly of flexible arrangements and uses.

"Resilient" means an object capable of returning to its original shape or position after being compressed.

"Rigid" means stiff or with a lack of flexibility. However, a "rigid" support system can flex or compact slightly under load, although to a lesser degree than a "resilient" support system.

The "upper" surface of a pavement module means the surface that is exposed when the pavement module is placed on a support.

"Impact absorption" means the ability to smooth or dampen shock forces and dissipate kinetic energy.

"Laying base" means the surface on which the pavement module or impact absorber is supported. In this invention, depending on the embodiment, the "laying base" may be the pavement or the protective shoe.

The shapes "substantially cylindrical", "substantially circular" are understood to be preferential shapes for the embodiment of the invention, which may work with other formats.

A "substantially centered" position is understood as a preferential position for the embodiment of the invention, which may work with other positions.

The application of the principles described herein is not limited to the specific embodiments presented.

The principles described herein can be used with any covering system.

Additionally, although some of the embodiments presented incorporate multiple new characteristics, the characteristics can be independent and do not all need to be used together in a single embodiment.

Pavement systems in accordance with the principles described herein may comprise any number of the presented characteristics.

Referencing the figures, the invention refers to a protective equipment against wear of rigid support elements or impact absorbers, intended to be used in pavement modules, especially in interconnected modules that form the covering of a pavement.

One aspect of this invention refers to a system of modules for pavements that includes a pavement module and a plurality of wear protectors for the rigid supporting elements connected to the pavement module.

The pavement module may have a construction in which the top surface is open, a solution usually used in pavements used in outdoor enclosures, or a construction in which the upper surface is closed, a solution usually used in indoor enclosures.

The protectors are mounted on the bottom surface of the pavement module.

The protector consists of a protective shoe (1). The aforementioned protective shoe (1) consists of the body of the shoe (1.1) which is substantially cylindrical in shape, with a first extremity open and a second extremity attached to the shoe base (1.2). The body of the shoe (1.1) has a plurality of shoe grooves (1.3) that fit into the second rigid support elements (M.3) of the pavement module (M). The shoe base (1.2) has a substantially circular shape and is attached to the second extremity of the body of the shoe (1.1).

The pavement module (M) comprises an upper surface enclosed by a layer of the top surface (M.1), a plurality of first rigid support elements (M.2), a plurality of second rigid support elements (M.3) and a plurality of recesses (M.4).

The protective shoe (1) is sized so that the first rigid support element (M.2) fits inside it. Therefore, the maximum outer diameter $D_3$ of the first rigid support element (M.2) must be equal to or slightly smaller than the maximum inner diameter $D_4$ of the protective shoe (1).

Individually mounted protectors on the pavement module (M) do not have to occupy all the first rigid support elements (M.2), so the number of buffers mounted on the pavement module (M) can vary between 1 and the number of first rigid support elements (M.2) in the pavement module (M).

In a first embodiment, the protective shoe (1) is placed on the outside of the first rigid support element (M.2), so that the outer walls of the first rigid support element (M.2) are in contact with the inner walls of the body of the shoe (1.1). The shoe grooves (1.3) fit into the second rigid support elements (M.3) of the pavement module (M).

When the second rigid supporting elements (M.3) fit into shoe grooves (1.3) and the body of the shoe (1.1) surrounds the first rigid supporting element (M.2), a base gap (1.2.1) is formed, i.e., there is a space between the second rigid supporting element (M.3) and the shoe base (1.2), which allows the second rigid support element (M.3) to descend when a force is exerted on the pavement module (M) until, at most, it touches the shoe base (1.2). At the same time, due to the body gap (1.1.1), i.e., the space between the body of the shoe (1.1) and the pavement module (M), when a force is exerted on the pavement module (M), the pavement module (M) descends until, at most, it touches the body of the shoe (1.1).

In a second embodiment in which impact absorbers are inserted (2) inside the first rigid support element (M.2), i.e., in the recess (M.4), the protective shoe (1) is placed outside the first rigid support element (M.2) after the impact absorber is placed (2), in which case the protective shoe (1) works as a wear protector of the impact absorber (2).

The protector is made of a non-resilient material, namely but not limited to polypropylene. Many other suitable materials are possible.

The invention claimed is:

1. Modular pavement system with a wear-protective system consisting of:

a pavement module comprising a layer of a upper surface, a plurality of a first rigid support elements, a plurality of a second rigid support elements and a plurality of recesses, and a wear protection system comprising at least one protective shoe formed by a shoe body enclosing a first rigid support element of the floor module, a shoe base and a plurality of shoe grooves wherein the shoe body is substantially cylindrical in shape and has a first end facing the pavement module and a second end facing the laying base, wherein the shoe base has a substantially circular shape and is attached to the second extremity of the body of the shoe and the plurality of the shoe grooves fits into the second rigid support elements of the pavement module.

2. Modular pavement system according to claim 1 wherein the maximum outer diameter of the first rigid support element being equal to or slightly smaller than the maximum inner diameter of the protective shoe.

3. Modular pavement system according to claim 1 wherein there is a base gap in the space between the second rigid support element and the shoe base.

4. Modular pavement system according to claim 3 wherein the second rigid support element descend until it touches the shoe base when a force is applied to the pavement module.

5. Modular pavement system according to claim 1 wherein there is a body gap in the space between the body of the shoe and the pavement module.

6. Modular pavement system according to claim 5 wherein the pavement module descends until it touches the body of the shoe when a force is applied to the pavement module.

* * * * *